United States Patent [19]

Pereda

[11] 3,979,924

[45] Sept. 14, 1976

[54] NONREFLECTING JEWELS FOR TELEVISION BROADCASTING USE

[76] Inventor: Eugene Falero Pereda, 11621 Hughes Ave., NE., Albuquerque, N. Mex. 87112

[22] Filed: Oct. 17, 1974

[21] Appl. No.: 515,462

[52] U.S. Cl. ..... 63/32; 350/276 R

[51] Int. Cl.[2] ..... A44C 17/00

[58] Field of Search ..... 63/32; 350/276 R, 276 SL, 350/156

[56] References Cited

UNITED STATES PATENTS

| | | | |
|---|---|---|---|
| 1,610,423 | 12/1926 | Cawley | 350/156 X |
| 1,734,979 | 11/1929 | Persons | 63/32 UX |
| 1,987,357 | 1/1935 | Bergen et al. | 63/32 UX |
| 2,348,636 | 5/1944 | McMahon | 63/32 UX |
| 2,437,126 | 3/1948 | Reardon et al. | 350/276 SLA |
| 2,773,411 | 12/1956 | Schwede | 350/276 R |
| 3,258,590 | 6/1966 | Goodbar | 350/276 R X |
| 3,808,836 | 5/1974 | Jones | 63/32 |

FOREIGN PATENTS OR APPLICATIONS

| | | | |
|---|---|---|---|
| 339,767 | 9/1959 | Switzerland | 63/32 |

*Primary Examiner*—F. Barry Shay

[57] ABSTRACT

A jewel for wear by television actors which consists of light-reflecting light-transmitting material. The jewel has cusps with external surfaces which reflect rays of light frontally approaching the jewel at Brewster's angle, thus substantially eliminating or greatly diminishing the amount of reflected light from such rays. A layer of carbon black may be used to absorb light portions which enter the jewel.

1 Claim, 3 Drawing Figures

NONREFLECTING JEWELS FOR TELEVISION BROADCASTING USE

This invention relates to the type of jewels that can be worn by television actors with impunity in the type of light phenomenon that naturally exists when regular jewels are used and which consists of complete "blooming" with light or with blackness of the television set raster by the intense reflection of light by such jewels. The phenomenon is due to the intense concentration of light on the television camera tube caused by the concentration of light from the jewel. The invention describes the makeup of the jewels that solve this problem but in no way deter from the attractiveness of the jewel.

A representative embodiment of this invention is here presented, but it will, of course, be appreciated that the invention is susceptible of incorporation in still other forms of wearing accouterments such as buttons, etc., and of course to household hanging objects such as lamp tear drops, adornments on doors also made of glass or reflecting materials where the same obnoxious phenomenon can occur.

CROSS REFERENCES

This invention has been disclosed to the U.S. Patent Office under the Document Disclosure Program with document No. 026986 with date Jan. 4, 1974, as recorded in that office.

IN THE ACCOMPANYING DRAWINGS

Figure 1:
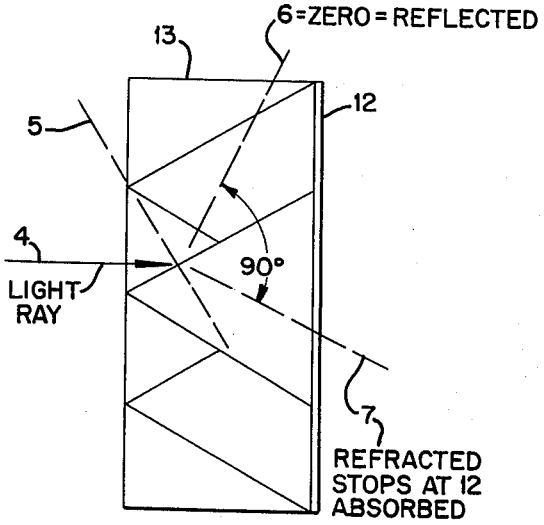
FIG. 1 is a Front View of the jewel makeup proposed.
Figure 2:
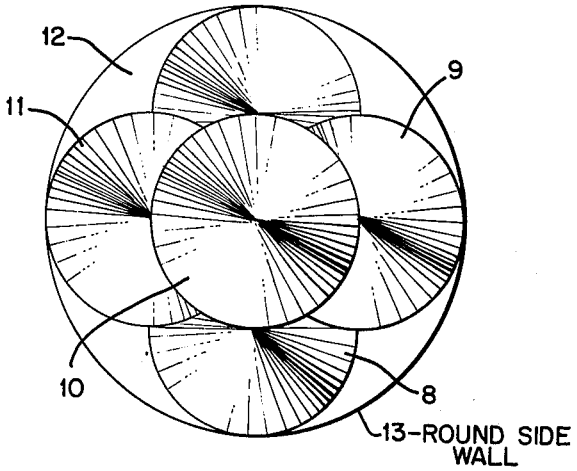
FIG. 2 is a Side View of FIG. 1.
Figure 3:
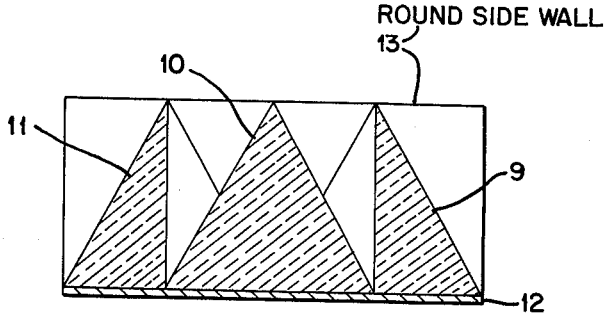
FIG. 3 is a Cross-Sectional but typical view of the jewel proposed.

The figures will depict the use of the main idea of the invention. The main idea is that instead of making the jewels so that they reflect the most light (as is commonly done in nearly all the jewels used for adornment) the use of the physical law of light reflection embodied in the name Brewster's angle is used. Such term refers to the angle of light reflection which does not allow light to come out of the material where the light impinges. This is based on the principle of Brewster's law of reflection which correlates polarization with the refractive index. This is mentioned here before the FIGS. 1, 2, 3, are explained because it is impossible to show the refractive index in the figure and Brewster's law shows the the angle of maximum polarization depends on such refractive index. The jewels here depicted are made of glass because for such the polarizing angle does not change much over the whole visible spectrum. Another way to express Brewster's law is to say that the light is "plane polarized". For glass the angle of incidence making operation of Brewster's law in accordance with this invention possible is 57°. The jewels are designed so that light hits the jewel's facets at this angle (from the perpendicular to such jewel's facets.) This will be shown referring to the figures alluding to the fact that under appropriate lighting conditions, no reflection from such facets can take place, the main nature of the invention here claimed. The jewels need not be made of glass only, the refractive index can be changed to fit any jewel design where the refractive index obtains the operation of such Brewster's law for the purpose of the invention effectiveness, e.g. that the reflected and refracted light from the jewel facets be at 90° from each other. The construction of the jewels here described for describing the invention have another advantage over ordinary jewels and that is that the refracted ray of light in the jewel itself is absorbed by a carbon black medium instead of being reflected by a mirrored surface as in ordinary jewels.

IN THE ACCOMPANYING DRAWING

FIG. 1 is the Side Elevation of the jewel, but with the facing part of the sidewall omitted to expose the cusps, representative of the invention;

FIG. 2 is a front elevation of the jewel, but with the facing part of the sidewall omitted to expose the cusps, and FIG. 3 is a Cross-sectional View of FIG. 2, such cross section showing the constructional features of the jewel. Numbers on the jewel drawings refer both to parts of the jewel and also direction of light rays impinging on the jewel, being reflected by the jewel (such reflection being kept at a minimum since this is the substance of the invention) and also the refracted ray of light in the jewel. The jewel in FIGS. 1–3 includes a flat bottom portion with cusps projecting perpendicularly from the bottom portion. Explicitly the number 4 shows a light ray approaching the jewel frontally and impinging the surface of a cusp at Brewster's angle (following Brewster's law) from the perpendicular (No.5) to the jewel cusp surface. No. 7 is the refracted ray inside the jewel, and No. 6 being the reflected ray, which in this case is greatly diminished and can even be zero, such being the object of the invention. Brewster's law calls for an angle of 90° between the refracted ray 7 and the reflected ray 6 in order that Brewster's law action take place, viz. greatly diminished reflection or no reflection. No. 8 is one cusp of the jewel, No. 9 another cusp of the jewel, No. 10 is the middle cusp of the jewel, No. 11 is another cusp of the jewel. No. 11, No. 12 and No. 13 are better referred to in FIG. 3, where No. 11 is the cusp, No. 12 is a feature of the jewel consisting of a layer of carbon black, covering the bottom of the jewel (also shown in FIG. 1 and FIG. 2) such carbon black being the agent that absorbs the refracted rays 7 in the jewel. The construction of the jewel is shown in simple terms with only a ray of light No. 4 impinging on the jewel face. The side of the jewel shown as No. 13 and which is a round side of opaque material completely around the jewel has the purpose of shielding light rays from the jewel and minimizing light rays at other than the Brewster's angle from the perpendicular to the jewel face or facets. This completely describes the make-up of the jewel with its cusps of glass.

I claim:

1. A jewel of light-transmitting, light-reflecting material comprising a generally flat bottom portion with cusps mounted thereon, said cusps projecting perpendicularly upwardly from said bottom portion and having light-reflecting surfaces which include means to greatly diminish the reflection by said surfaces of light which approaches said jewel frontally in a direction perpendicular to said flat bottom portion, said means comprising that the angle of said surfaces to said bottom is defined such that said perpendicularly approaching light strikes said surfaces at an angle which is substantially equal to Brewster's angle for the material of said cusps.

* * * * *